US011035120B2

(12) United States Patent
Claeys

(10) Patent No.: US 11,035,120 B2
(45) **Date of Patent: *Jun. 15, 2021**

(54) CURTAIN WALL

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina R. Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 238 days.

This patent is subject to a terminal disclaimer.

(21) Appl. No.: 16/303,736

(22) PCT Filed: May 2, 2017

(86) PCT No.: PCT/BE2017/000025

§ 371 (c)(1),
(2) Date: Nov. 21, 2018

(87) PCT Pub. No.: WO2017/201587

PCT Pub. Date: Nov. 30, 2017

(65) Prior Publication Data

US 2020/0332524 A1 Oct. 22, 2020

(30) Foreign Application Priority Data

May 24, 2016 (BE) ..... 2016/5379

(51) Int. Cl.
*E04B 2/96* (2006.01)

(52) U.S. Cl.
CPC ..... *E04B 2/965* (2013.01); *E04B 2/962* (2013.01)

(58) Field of Classification Search
CPC ..... E04B 2/965; E04B 2/962
See application file for complete search history.

(56) References Cited

U.S. PATENT DOCUMENTS 3,081,849 A 3/1963 Hubbard
4,638,613 A * 1/1987 Tonsmann ..... E04B 1/24 52/200

(Continued)

FOREIGN PATENT DOCUMENTS

CL 201401909 7/2013
CL 201803325 11/2017

(Continued)

OTHER PUBLICATIONS

International Search Report in related PCT/BE2017/000025, dated Oct. 24, 2017.

(Continued)

*Primary Examiner* — Rodney Mintz
(74) *Attorney, Agent, or Firm* — Bacon & Thomas, PLLC

(57) ABSTRACT

Curtain wall including mullion profiles, transom profiles and panels, where the mullion profiles extend vertically, with the transom profiles being fixed at right angles to the mullion profiles, where the transom profiles and the mullion profiles define rectangular openings. The panels are placed in the openings to close these openings, where the panels are secured by means of first glazing beads, that are attached to the mullion profile by means of first attachment aids, where the first attachment aids and the mullion profiles are designed to attach the first attachment aids to the mullion profile, where the first attachment aids and the first glazing beads are designed to snap the first glazing beads onto the first attachment aids.

15 Claims, 13 Drawing Sheets

(56) References Cited

U.S. PATENT DOCUMENTS

| | | | | |
|---|---|---|---|---|
| 4,756,132 | A | 7/1988 | Newman et al. | |
| 6,804,920 | B2 * | 10/2004 | Hogan | E04B 2/96 52/204.5 |
| 9,163,400 | B2 * | 10/2015 | Lang | E04B 2/88 |
| 9,212,482 | B2 * | 12/2015 | Frederick | E04B 2/96 |
| 10,060,128 | B2 * | 8/2018 | Ander | E04B 2/96 |
| 10,914,066 | B2 * | 2/2021 | Claeys | E04B 2/967 |
| 10,934,707 | B2 * | 3/2021 | Claeys | E06B 3/5427 |
| 2003/0226324 | A1 | 12/2003 | Hogan | |
| 2012/0210664 | A1 * | 8/2012 | Lang | E04B 2/88 52/407.2 |
| 2013/0186031 | A1 | 7/2013 | Ting | |
| 2015/0284951 | A1 * | 10/2015 | Frederick | E04B 2/90 52/235 |
| 2018/0023295 | A1 * | 1/2018 | Ander | E04B 2/967 52/204.62 |
| 2019/0136523 | A1 * | 5/2019 | Claeys | E04B 2/965 |
| 2019/0194939 | A1 * | 6/2019 | Frederick | E04B 2/967 |
| 2019/0234071 | A1 * | 8/2019 | Claeys | E04B 2/967 |
| 2020/0032509 | A1 * | 1/2020 | Claeys | E04B 2/90 |
| 2020/0032510 | A1 * | 1/2020 | Claeys | E06B 1/366 |
| 2020/0318346 | A1 * | 10/2020 | Claeys | E04B 2/967 |

FOREIGN PATENT DOCUMENTS

| | | | | |
|---|---|---|---|---|
| CL | 201803326 | | 11/2017 | |
| EP | 0392033 | A1 * | 10/1990 | E06B 3/5427 |
| JP | 57190086 | S | 12/1982 | |
| RU | 2178502 | C2 | 1/2001 | |

OTHER PUBLICATIONS

6/ritten Opinion in related PCT/BE2017/000025, dated Oct. 24, 2017.

Belgium Search Report in related Belgium Application No. 201605379, dated Nov. 30, 2016.

International Preliminary Report on Patentability in related PCT/BE2017/000025, dated May 4, 2018.

Chilean Office Action in corresponding Chilean Application No. 201803328, dated Apr. 13, 2020.

Eurasian Office Action in corresponding Eurasian Application No. 201892720, dated Feb. 26, 2020.

Moroccan Office Action in corresponding Moroccan Application No. 44181, dated Feb. 15, 2019.

Chilean Search Report in corresponding Chilean Application No. 201803328, dated Apr. 13, 2020.

* cited by examiner

CURTAIN WALL

BACKGROUND OF THE INVENTION

1. Field of the Invention

The present invention relates to a curtain wall.

This is a structure comprising of mullion profiles and transom profiles in which panels, usually glass panels, but closed panels are also possible, are placed to form a non-load-bearing outer wall.

A disadvantage of the known curtain walls is that the mullion profiles and transom profiles are designed in such a way that construction must be done from the outside.

2. Related Art

An example of such a known curtain wall is described in U.S. Pat. No. 3,081,849, the mullions and transoms being constructed from an inner profile on the inside of the curtain wall and from an outside profile on the outside thereof, with the outer profile being snapped along the outside of the curtain wall and the panels with their side edges being fitted between the two profiles with the aid of seals.

Other examples are known from U.S. Pat. No. 4,756,132 and JPS 57.190086 in which glazing beads must be hooked together with their seals in an inner profile in a direction perpendicular to the plane of the facade, before the panels can be placed along the outside of the facade and secured by means of an outer profile that is snapped or screwed into place.

An installation from the outside is not only a disadvantage, but it is in no way technically similar to a facade system mountable from the inside. Both execution techniques have virtually no similarities.

This fact is not related to the knowledge that an installation at certain heights is not only complex, but requires scaffolding or suspended working platforms and is dangerous for the persons who perform this work and for those who might pass under it.

An installation of the panels from the inside would be much easier and safer because there are floors at regular intervals.

However, there is a problem in this that glazing beads, which are necessary to secure a panel firmly against the mullion profiles and the transom profiles, are not easily applied.

The patent application US 2003/0226324 describes a curtain wall system, wherein the applicant claims that this system is suitable for installing and replacing the panels both from the outside and from the inside of the curtain wall if necessary. However, this is not possible without certain parts of the mullions and transoms being disassembled to provide enough room to rotate the panels from the inside of the curtain wall without having the panels' upper or lower side edge collide with an inner wall of the transoms.

The US 2003/0226324 curtain wall system provides for the installation of single and double glazed glass panels, in the case of double glazing the panels are sealed between rubber seals and in the case of a single glazing the difference in thickness with the double glazing is accommodated by one of the aforementioned seals attached to a glazing bead, wherein the glazing bead and this seal, are first hooked together in a mullion profile or in transom profile and then rotated in with force.

Mounting the glazing beads in such a way is not only difficult, but also contains the risk of damage to the panels.

SUMMARY OF THE INVENTION

The object of the invention is to provide a solution to the aforementioned and other disadvantages, and to this end it concerns a curtain wall comprising of one or more mullion profiles, one or more transom profiles and one or more panels, preferably glass panels, wherein the one or more mullion profiles extend vertically, wherein the one or more transom profiles are attached perpendicular to the one or more mullion profiles, wherein the one or more transom profiles and the one or more mullion profiles define rectangular openings, wherein the one or more panels are positioned in said openings to close these openings, wherein the panels are fitted with their side edges in a rabbet of the mullion profiles and the transom profiles with the aid of seals and wherein the rabbets in the mullions have a fixed indivisible width and the one or more panels along the inside of the curtain wall are fixed in the mullion profiles by means of the first glazing beads, these glazing beads being made of a rigid material and provided with an aforementioned seal and attached to a said mullion profile by means of the first attachment aids, wherein the first attachment aids and the one or more of said mullion profiles are designed to attach the first attachment aids, preferably by a snapping system, to a said mullion profile, wherein the first attachment aids and the first glazing bead are designed to snap the first glazing beads onto the first mounting aids in a direction parallel to the plane of the panel (4) in question.

In this way, the first glazing beads can be easily attached, simply by sliding them past a mounted panel and snapping them into place from the inside of the curtain wall. This allows the panels to be fitted from the inside.

This also allows greater freedom in the design of the mullion profiles, because the placement possibility for first glazing beads is already provided. The first attachment aids can already be attached prior to the installation of a panel, while a glazing bead can only be installed later, thus limiting the connection possibilities of a glazing bead directly to a mullion profile.

Also, connection points for the first glazing beads directly to the mullion profiles may be undesirable to prevent other technical problems, for example related to waterproofing or a construction process of a frame structure of mullion profiles and transom profiles. Thanks to the first attachment aids, first glazing beads for can still be used without connection points, that would otherwise be necessary.

Preferably, the first attachment aids are made of plastic and the first glazing beads are made of aluminium.

Thanks to plastic first attachment aids, costs can be saved on the relatively expensive aluminium.

In yet another preferred embodiment, the first attachment aids and the one or more said mullion profiles are adapted to snap the first attachment aids onto a said mullion section in a direction perpendicular to the plane of the panel in question, wherein the first attachment aids and the first glazing beads are arranged to snap the first glazing beads onto the first attachment aids in a direction parallel to the plane of the panel in question.

In yet another preferred embodiment, the first attachment aids are profiles extending over only a portion of the length of the first glazing beads.

In yet another preferred embodiment, each of the first glazing beads are secured to a mullion profile by a minimum of two first attachment aids, that are placed some distance apart.

Preferably, the distance between the first attachment aids is between 300 and 1200 mm.

Preferably the length of the first attachment aids is between 20 and 150 mm.

In yet another preferred embodiment, the one or more of said mullion profiles and the first glazing beads are arranged in such a way that the first glazing beads rest against the mullion profile with their side facing away from the panel in question.

In a preferred embodiment, the one or more panels are secured by means of second glazing beads attached to a said transom profile by means of second attachment aids, wherein the second attachment aids and the one or more of said transom profiles are designed to be able to attach the second attachment aids to a said transom profile, wherein the second attachment aids and the second glazing beads are designed to be able to snap the second glazing beads onto the second attachment aids.

The advantages mentioned in connection with the first glazing beads and the mullion profiles are therefore also applicable to the transom profiles and the second glazing beads.

The mullion profiles and transom profiles are preferably composite profiles, each of which is composed out of two or more sub-profiles, which are not necessarily made of the same material.

In a still another preferred embodiment, a barrier for water is provided at the fixing points of the transom profiles on the mullion profiles, wherein the barrier is adapted to divert this water to a said transom profile, wherein the transom profiles are adapted to drain this water to the exterior of the curtain wall.

Here, the exterior of the curtain wall is the side exposed to atmospheric influences.

The advantage is that the mullion profiles do not need to be equipped with water drains, but that any infiltration water in the curtain wall can be evacuated for each facade plane separately, as opposed to traditional curtain walls, where infiltration water is collected and drained across multiple facade planes.

This also results in a vertical and horizontal sealing of the mullion profiles for each panel, so that any possible water leak can be assigned with certainty to a problem with respect to the placement of that particular panel or the mullion profiles or transom profiles around that particular panel and finding and solving a problem is thus much easier.

While in the traditional curtain walls water is led from the transom profiles to the mullion profiles and drained from there, the curtain wall according to the invention is designed to guide water from each panel separately from the mullion profiles to the transom profiles and to drain the water therefrom.

Preferably, the transom profiles are designed to drain said water to the outside of the curtain wall because the transom profiles, or a different profile attached to the transom profiles, such as for example a glass frame, are equipped with water drainage openings on the outside, wherein these drainage openings are located at a distance from the mullion profiles. Preferably this distance is between 10 and 300 mm.

In a further preferred embodiment, the transom profiles are designed in such a way that the section of the transom profiles to which said water is diverted, is positioned horizontally or slanting to the outside, wherein the transom profiles comprise a sub-profile made in one piece; the sub-profile being part of said section to which said water is diverted and wherein the sub-profile is provided with an upright edge on the inside of said section.

The section is made of a single piece of aluminium and is therefore waterproof. Thanks to the upright edge, inward leakage is prevented, even if a small amount of water should come onto the transom profiles, as long as this amount does not rise above the edge.

In a still another preferred embodiment, the barriers are formed by flexible plastic or rubber seals, wherein the seals are placed on ends of the transom profiles and wherein the shapes of the mullion profiles and the seals are adapted to each other to achieve a watertight connection between the transom profiles and the mullion profiles at the locations of the aforementioned attachment points.

Such seals are a practical way of obtaining such a barrier, are durable over time and can accommodate any possible small movement of the curtain wall.

Such seals are a practical way of obtaining such a barrier.

In yet another preferred embodiment, the seals are provided with a deformable hollow chamber to facilitate the placement of the seals.

Thanks to this deformable chamber, the seals can be deformed during the placement, facilitating the placement while retaining the desired shape after the placement.

In a further preferred embodiment, a seal is provided at each of the two ends of the transom profiles, wherein at least one, and preferably exactly one, of the seals of a transom profile is slidable on the transom profile, preferably over a distance of at least 1 and up to 12 mm, to accommodate small movements.

Under the influence of the wind and over time, small deformities can occur in the curtain wall. In order to ensure that these do not lead to high stress, which could lead to a breakage, said slideability is desirable.

In yet another preferred embodiment, the seals comprise a flat end wall that is perpendicular to the profile direction of the transom profiles, wherein the end wall is completely closed in the profile direction of the transom profiles and the end wall is resting against a mullion profile.

This prevents any infiltration water from flowing past the seals and seeping downwards.

In a further preferred embodiment, the curtain wall comprises mullion profiles, transom profiles and one or more panels, wherein the mullion profiles are provided on each side with a groove for clamping the side edge of a panel, wherein the grooves have an access opening, wherein the access opening has a first dimension in horizontal direction, wherein the transom profiles in the horizontal direction and at right angles to the profile direction of the transom profiles have a second dimension, wherein the second dimension is larger than the first dimension, wherein the transom profiles in a non-horizontal direction at right angles to the profile direction have a third dimension, wherein the third dimension is smaller than the first dimension, so that the ends of the transom profiles fit through the access opening, in a rotated state of the transom profiles in which the direction of the third dimension is horizontal.

In this embodiment, the mullion profiles are made of a single piece or of multiple connected non-detachable sub-profiles.

Such a curtain wall is easy to build from the inside without requiring many actions, because the aforementioned features allow the transom profiles to be placed in a groove around their longitudinal axis, and then simply get their desired orientation by rotation and to be fixed in the grooves.

In yet another preferred embodiment, one or more walls of the grooves are provided with a recess in which a section of the transom profiles is located, wherein the transom profiles is supported vertically by a bottom edge of said recess.

This is an easy way to attach the transom profiles to the mullion profiles without requiring further attachments. In addition, such a suspension allows the transom profiles to have some play in their profile direction, which is desirable to accommodate stress in the curtain wall.

In yet another preferred embodiment, the transom profiles are Z-profiles, with a first vertical leg directing upward and located on the inside of the transom profile, a second vertical leg directing downward and located on the outside of the transom profile, and a horizontal spacer section between the first and the second leg.

Due to the vertical legs, sufficient rigidity is obtained, while the horizontal spacer section allows sufficient space to install a panel above the transom profile.

Indeed, due to this construction of the transoms, the openings for the panels defined by the mullions and transoms in the curtain wall are sufficiently large to enable the installation of the panels from the inside of the curtain wall.

In this embodiment, a panel that is to be installed is, for example, first placed slantingly with respect to the plane of the curtain wall opposite a said opening and in this slanting position, with a side edge in a deep rabbet of one of the two adjoining mullion posts, after which the panel, with this side edge as a pivot point, is rotated into the opening to then be shifted sideways until both side edges of the panel are fitted in a rabbet. After that, the glazing beads can easily be snapped into place as described.

Due to the shape of the transoms without a downwardly directed leg on the inside of the curtain wall, there is sufficient space between the transoms in the opening in the vertical direction on the inside of the curtain wall to allow a panel to rotate into place without it colliding with a top or lower edge against a transom.

In yet another preferred embodiment, the transom profiles are provided with an undercut groove which runs in the profile direction and with a rod inserted in the undercut groove, wherein the mullion profiles have a second groove for receiving the end of said rod projecting out from the undercut groove, thereby blocking any rotational movement of the transom profiles.

Such an arrangement prevents the transom profiles from being detached from the transom profiles by rotation.

In a still another preferred embodiment, said grooves on the different sides of the mullion profiles have a different depth.

This also allows the panels to be placed from the inside by shuffling a panel into the deepest groove, then shifting it into the desired orientation and then shuffling it towards the shallow groove.

In yet another preferred embodiment, the mullion profiles and the transom profiles are composite profiles, each composed of two or more sub-profiles, wherein the sub-profiles are not necessarily made of the same material.

This results in good thermal insulation, for example by working with an aluminium outer and inner sub-profile, connected by insulating plastic profiles.

Preferably the panels are glass panels.

BRIEF DESCRIPTION OF THE DRAWINGS

With the intention of better showing the characteristics of the invention, a preferred configuration according to the present invention is described hereinafter by way of an example, without any limiting nature, with reference to the accompanying drawings, wherein:

FIGS. 2 and 3 schematically represent a cross-sectional view of the curtain wall of FIG. 1 taken along line II-II, in which parts are omitted for clarity's sake in both figures;

DETAILED DESCRIPTION OF THE INVENTION

The curtain wall 1 shown in FIGS. 1 to 5 consists of a structure of vertical mullions 2 between which horizontal transoms 3 are attached. In the openings formed by the mullions 2 and the transoms 3, panels are placed, in this example, but not necessarily, glass panels 4, which are seated with their edges in the mullions 2 and the transoms 3.

Figure 6:
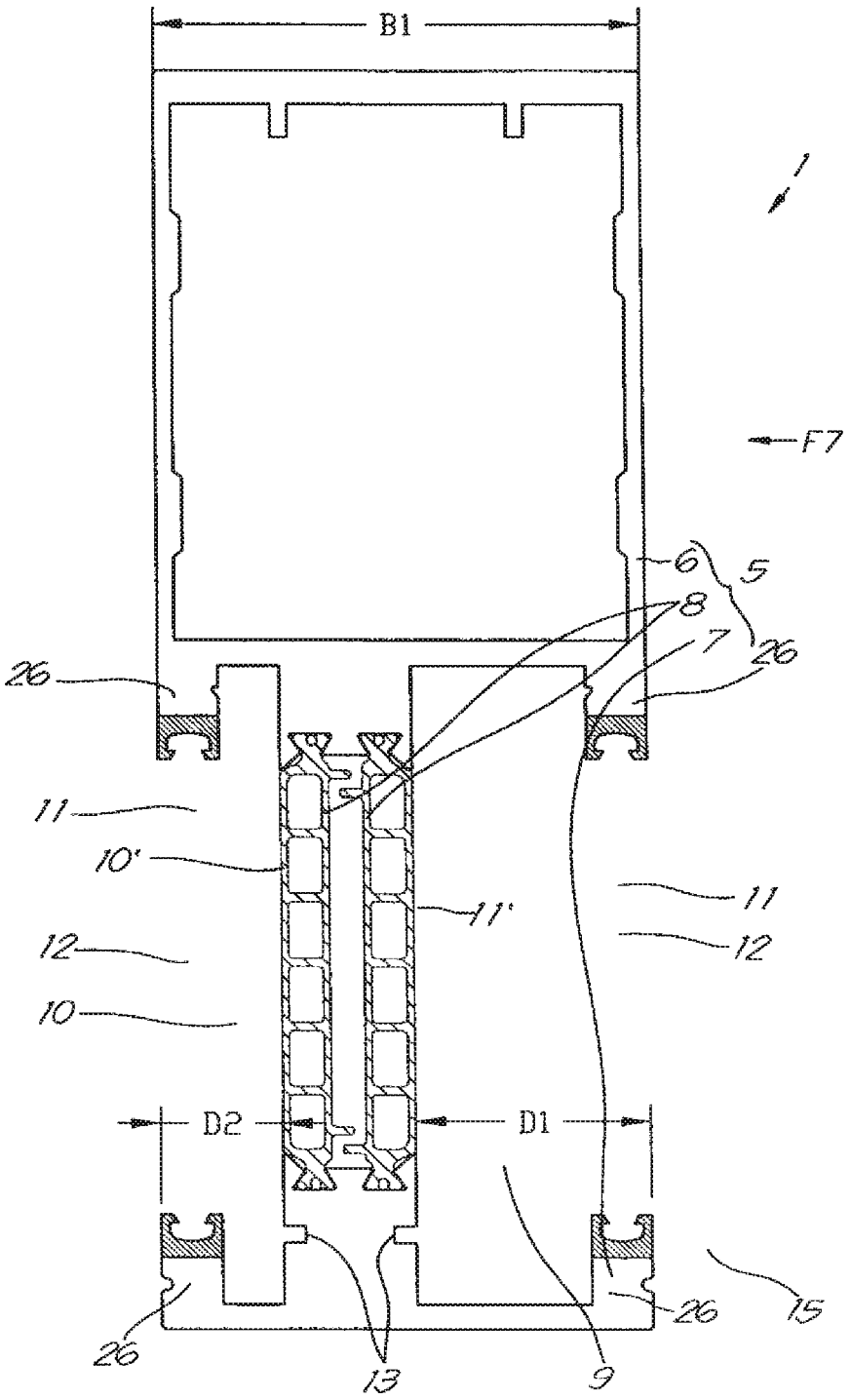
FIG. 6 schematically represents a part of the curtain wall of FIG. 1 and shows a step in the manufacturing procedure of the curtain wall of FIG. 1.

The mullions 2 are formed by mullion profiles 5 with a width B1 of 56 mm. The mullion profiles 5 are shown separately in a cross-sectional view in FIG. 6.

The vertical mullion profiles 5 consist of four sub-profiles, namely an aluminium tubular sub-profile 6 on the inside, an aluminium sub-profile 7 on the outside and two plastic insulation profiles 8. These four sub-profiles 6, 7, 8 are assembled into a monolithic entity by means of rolling, i.e. mechanical deformation of lips on the aluminium sub-profiles 6, 7 to clamp the plastic profiles 8.

Figure 1:
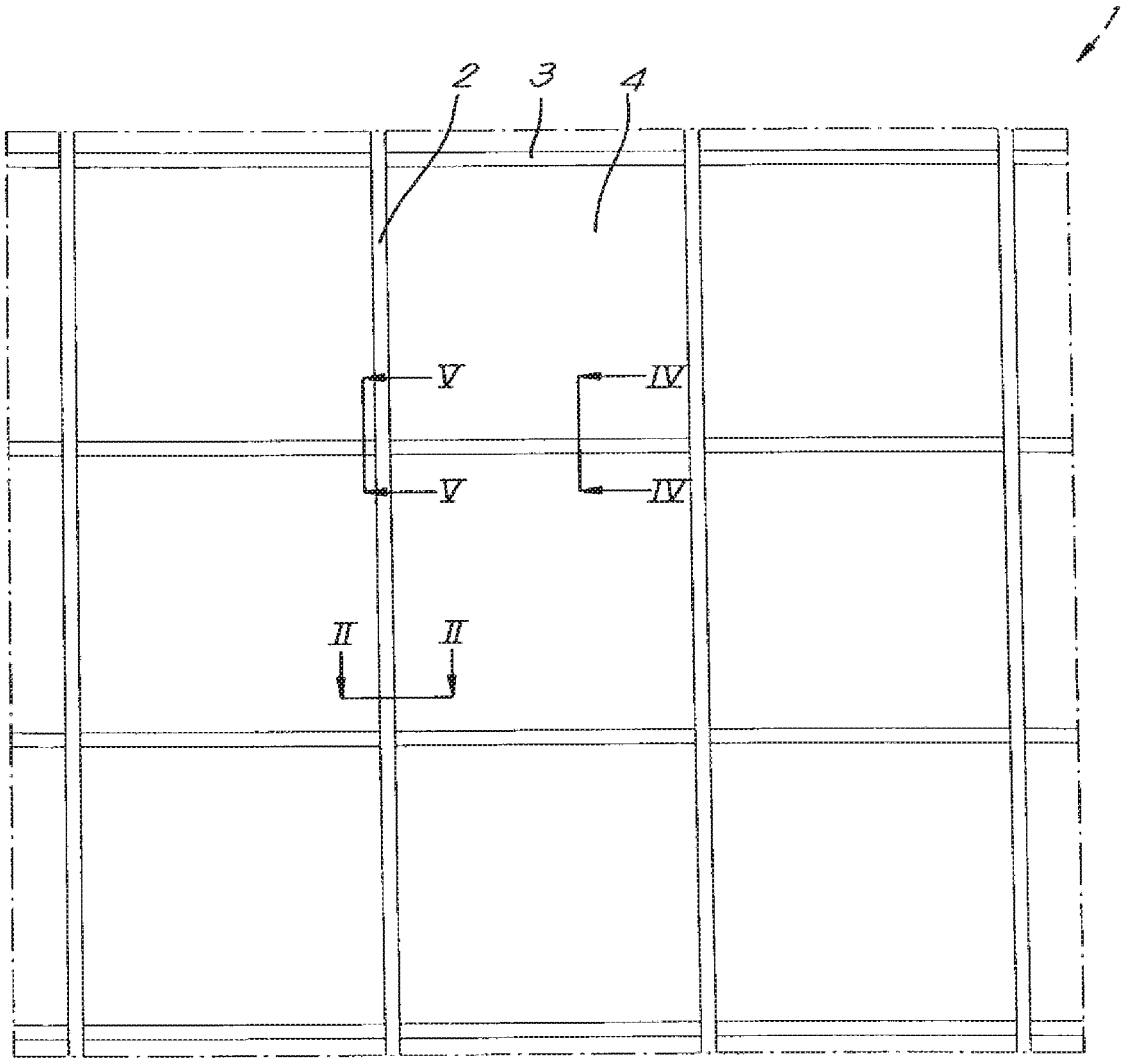
FIG. 1 schematically represents an outer view of a curtain wall according to the invention.
Figure 2:
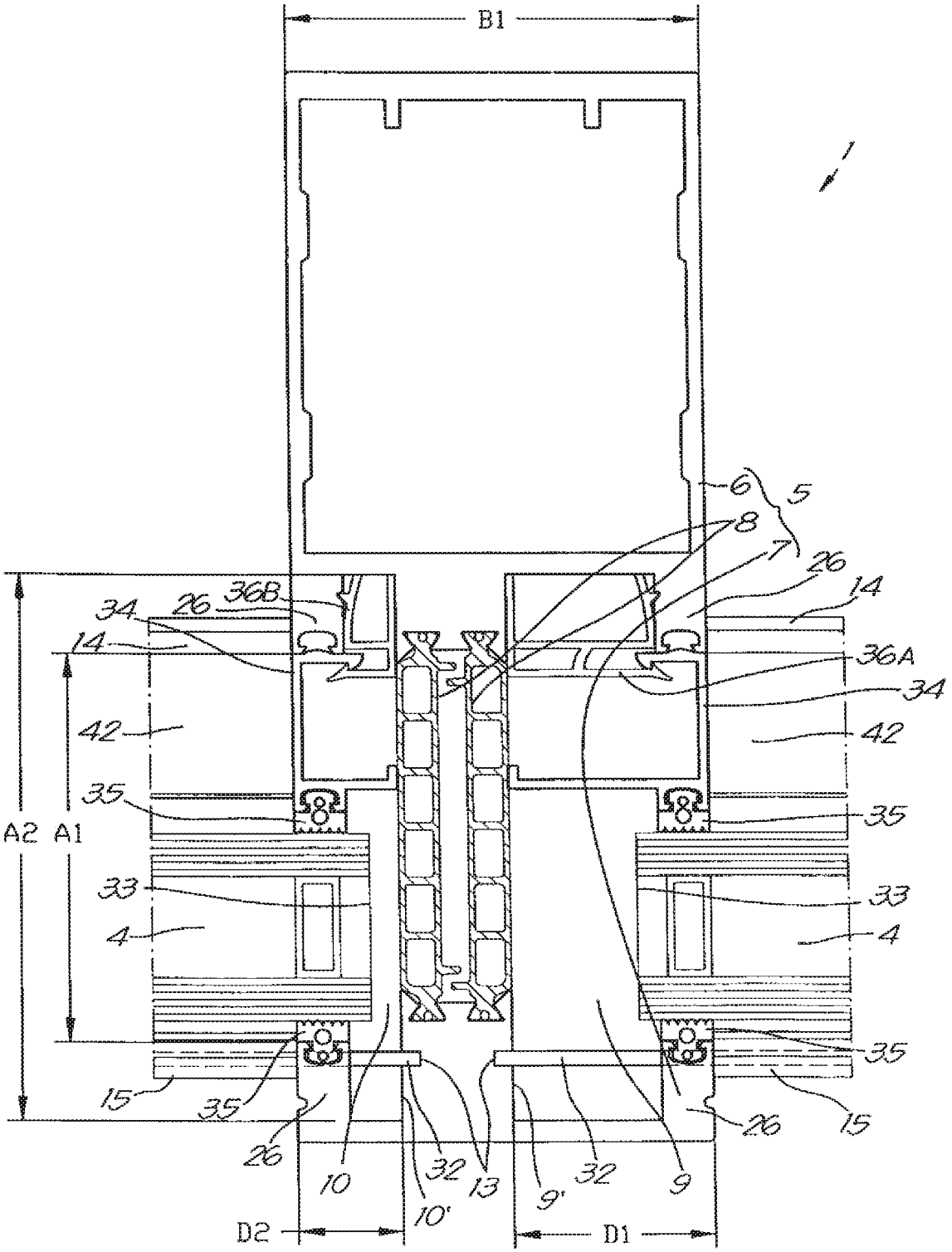

The mullion profiles 5 have a lateral undercut groove on both sides, namely a deep lateral groove 9 on one side, in FIGS. 2 and 3 on the right side, and a shallow groove 10 on the other side. The deep lateral groove 9 has a depth D1 of 28 mm, and the shallow lateral groove 9 has a depth D2 of 14 mm.

Both grooves 9 and 10 serve as a rabbet 11 for the side edges of the panels 4. The access opening 12 of the lateral grooves 9, 10 has a horizontal dimension, which is 54 mm wide. The maximum horizontal dimension A2 of the lateral grooves 9, 10 is approximately 76 mm.

The sub-profiles 6, 7 and 8 of the mullion profiles 5 are inseparably connected to each other, which means that they cannot be uncoupled from each other without causing irreversible damage. This means that the grooves 9 and 10 cannot be opened without damage and thus that the width A1 of the access opening 12 is a fixed size. At the bottom 9' and 10' of the two lateral grooves 9, 10 a narrow second groove 13 is provided.

The transoms 3 are mainly formed by transom profiles 14 onto which an aluminium glazing beads 15 are attached to the outside of the curtain wall 1. The transom profiles 14 are shown separately in a cross-sectional view in FIG. 8.

The transom profiles 14 are Z-shaped profiles, having a first vertical leg 16 on the inside, a second vertical leg 17 on the outside and a section 18 between both legs 16, 17.

The transom profiles 14 have a total height H1 of 56 mm and a horizontal dimension A3 of 64 mm.

Figure 8:
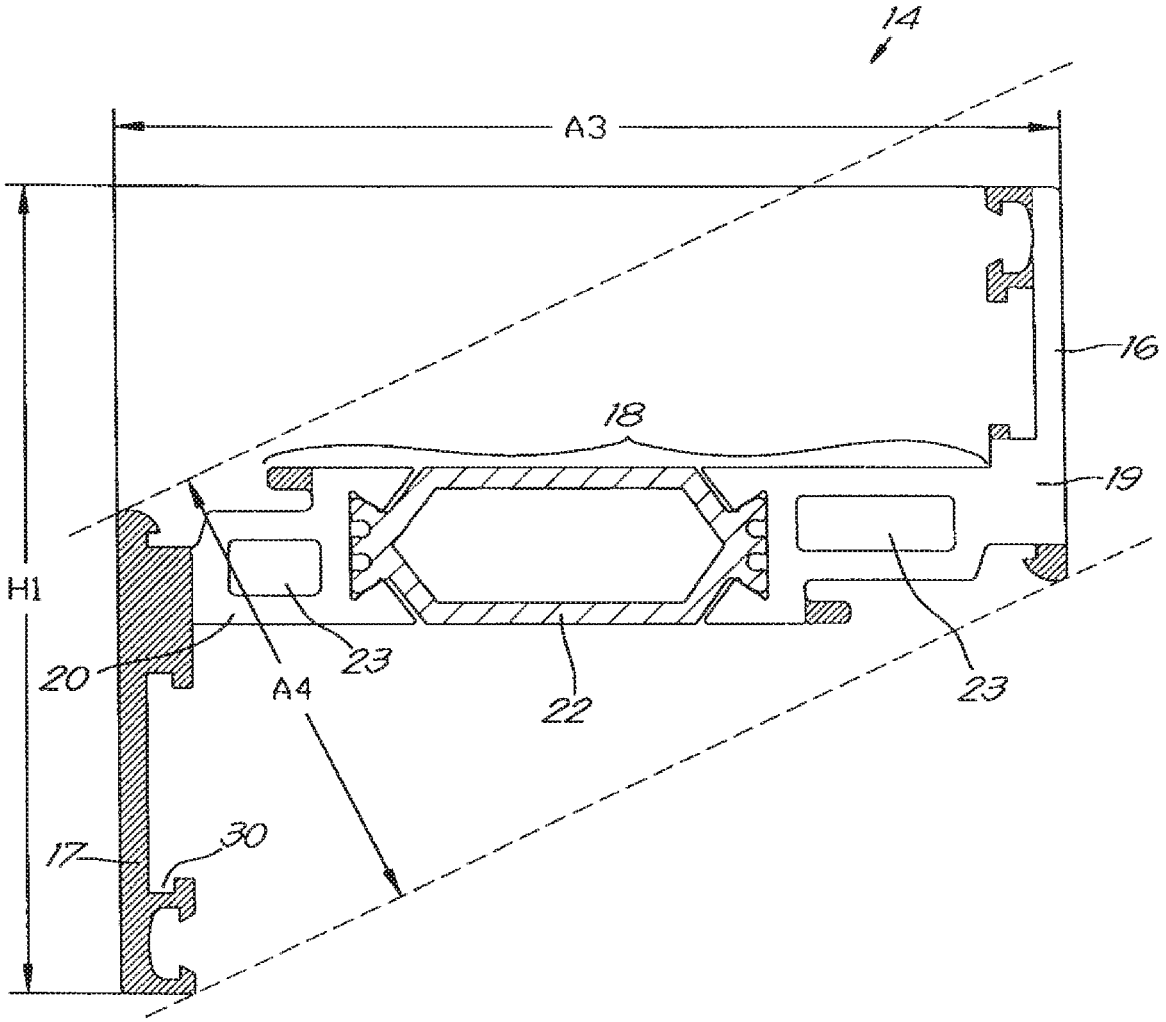
FIG. 8 schematically represents a part of the curtain wall of FIG. 1 and shows a step in the manufacturing process of the curtain wall of FIG. 1.

It is important to note that in a slanting direction, deviating approximately 60° from the horizontal direction, the transom profiles 14 have a much smaller dimension A4 of about 34 mm as shown in FIG. 8.

The transom profiles 14 consist of three sub-profiles, namely an aluminium inner sub-profile 19, a portion of which forms the first leg 16, an aluminium outer sub-profile 20, a portion of which forms the second leg 17 and a plastic insulation profile 22. These three sub-profiles 19, 20, 22 are firmly attached to each other by means of rolling, i.e. mechanical deformation of lips on the aluminium sub-profiles 19, 20 in order to clamp the plastic profiles 22.

The inner and outer section profiles 19, 20 are each provided with an internal chamber 23.

Figure 4:
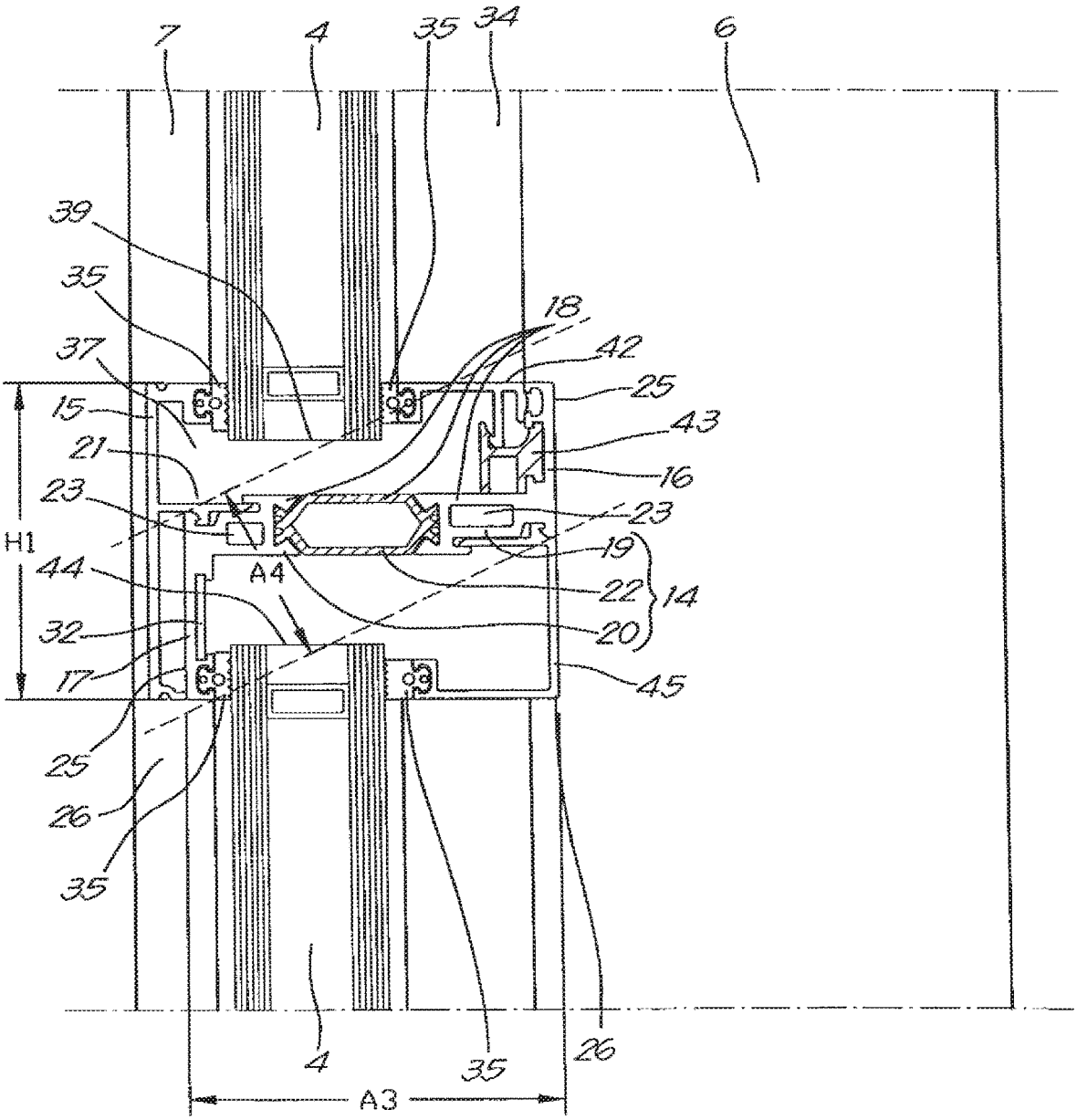
FIG. 4 schematically represents a cross-section of the curtain wall of FIG. 1 along line IV-IV.
Figure 5:
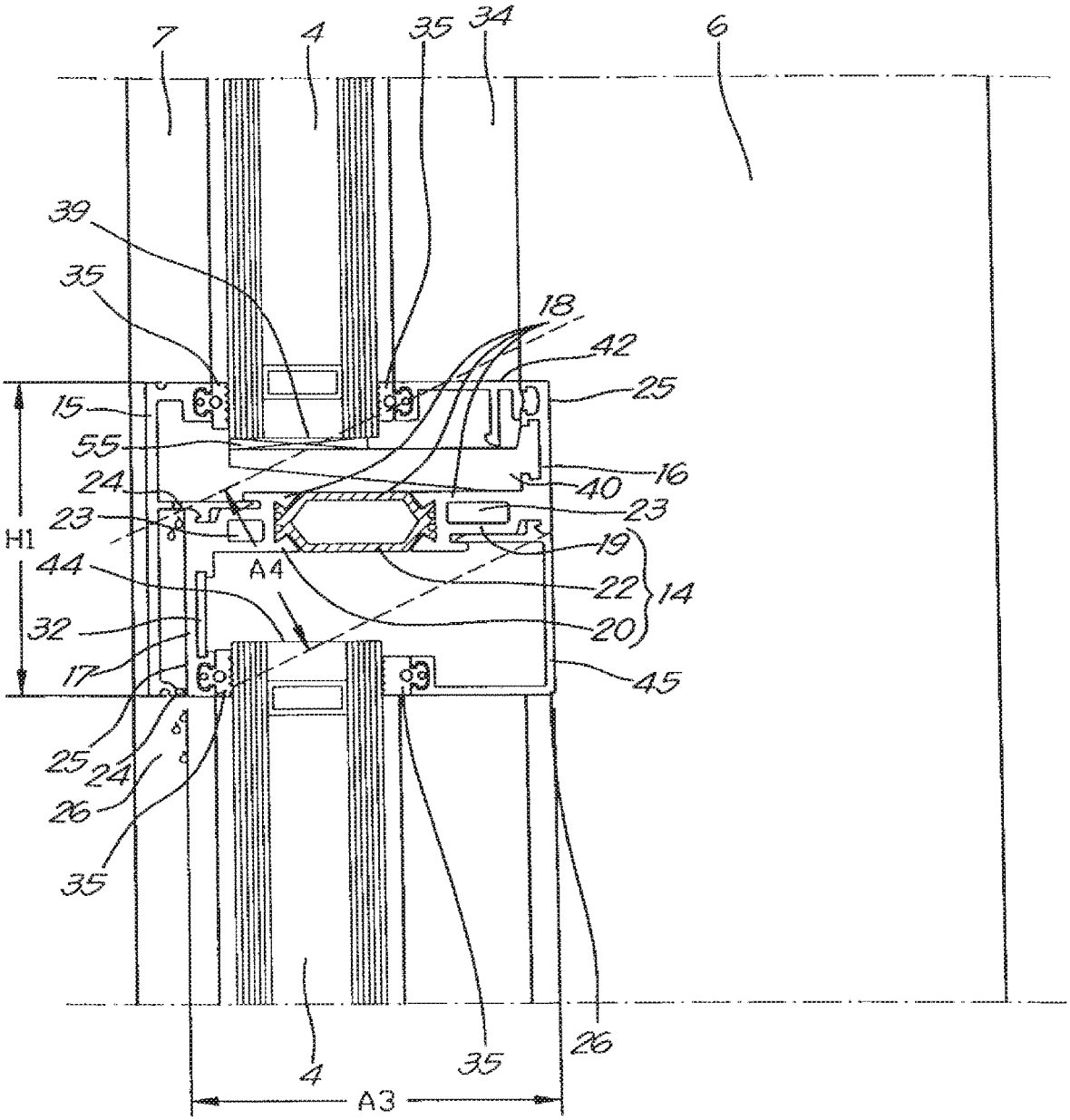

As illustrated in FIG. 4, the glazing beads 15 are provided with clipping parts 21 or other fastenings in order to attach them to the transom profiles 14, for example against the vertical leg 17 on the outside of the curtain wall 1.

Figure 5:
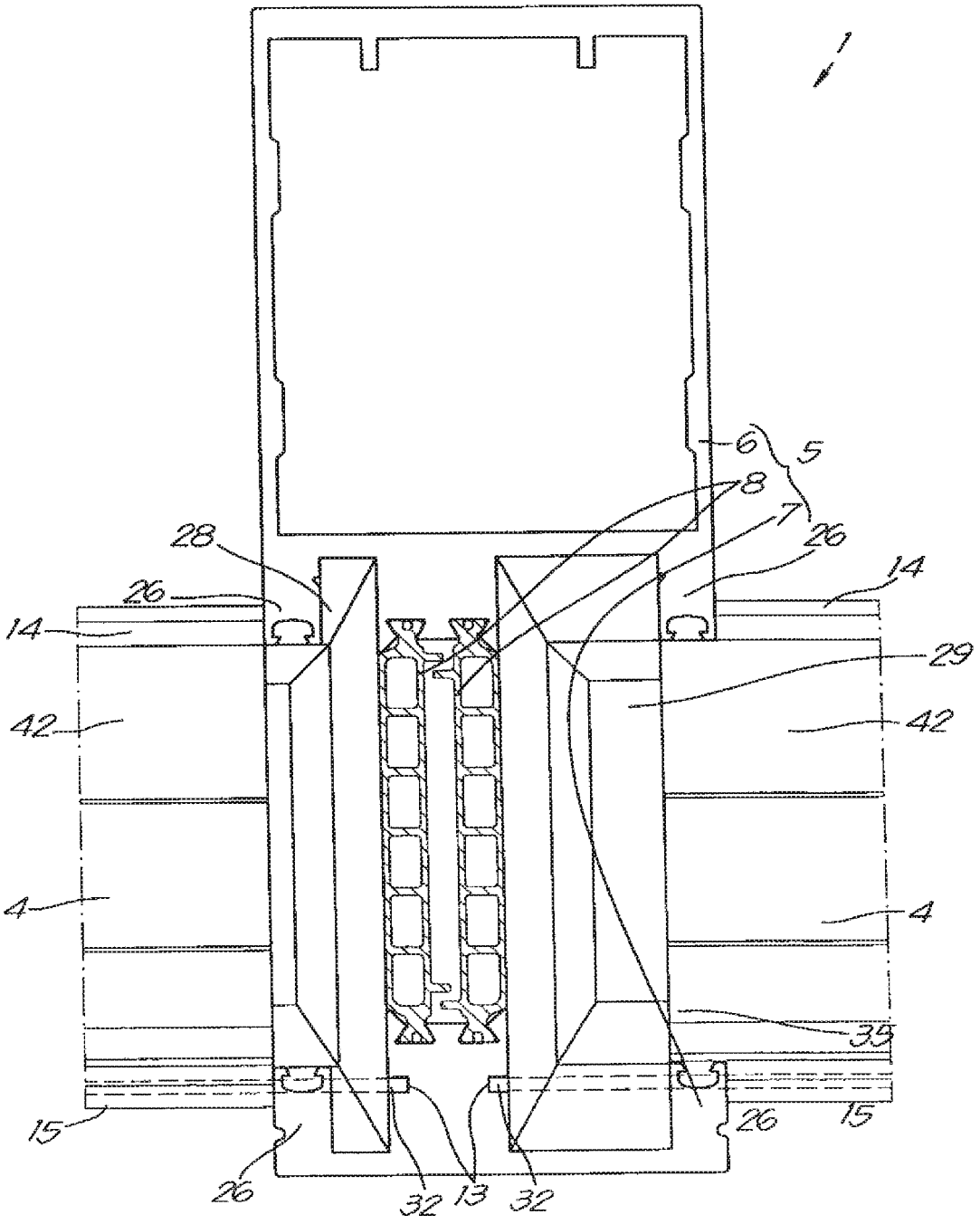
FIG. 5 schematically represents a cross-section of the curtain wall of FIG. 1 along line V-V.

As is particularly apparent from FIG. 5, the glazing beads 15 are provided with water drainage openings 24 at a small distance from the mullion profiles 5. Such drainage openings 24 may additionally also be provided in one or more other locations in the glazing beads 15. This depends on the length of the transoms 3.

Figure 7:
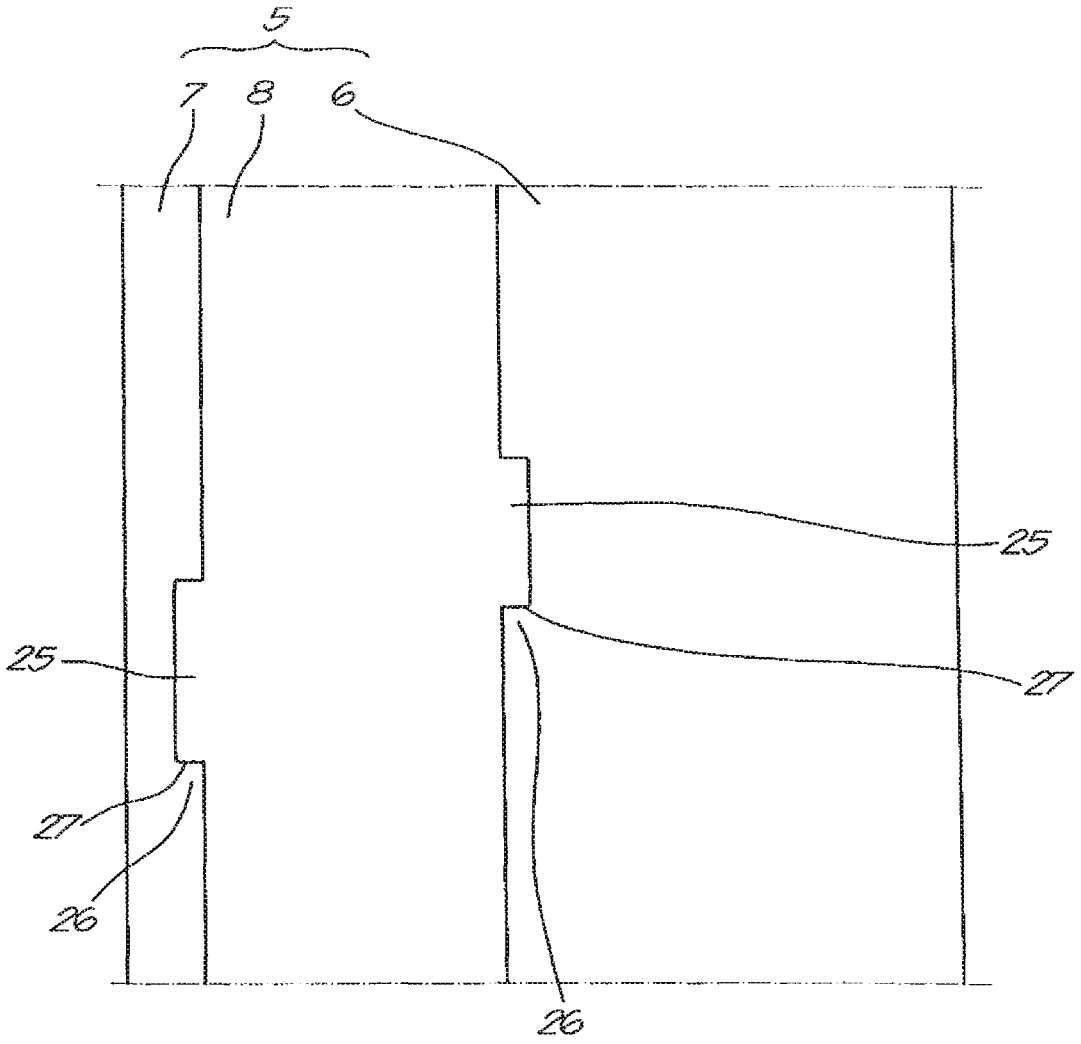
FIG. 7 schematically represents the result of the step of FIG. 6 in a view according to F7.
Figure 11:
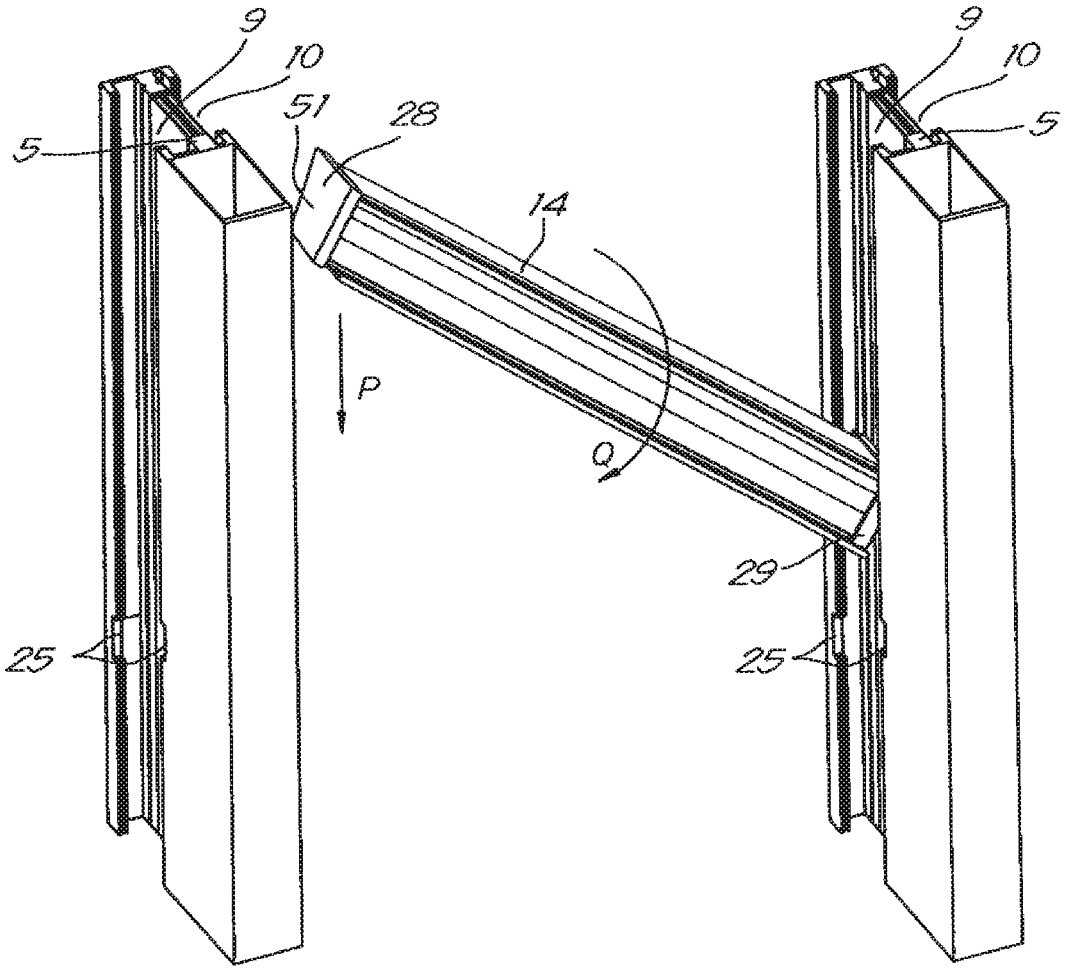
FIG. 11 schematically shows a next step in the manufacturing process of the curtain wall of FIG. 1 in perspective.

The transom profiles 14 are attached to the mullion profiles 5 because parts of the transom profiles 14, and more specifically the first and second legs 16, 17, rest in the recesses 25 shown in FIGS. 7 and 11 in the walls 26 of the lateral grooves 9, 10 of the mullion profiles 5 and are vertically supported by the bottom edge 27 of these recesses 25. How this is achieved will be explained later.

At the ends of the transom profiles 14, sealing pieces 28, 29 are provided that are made of rubber with a Shore hardness of 75. These sealing pieces 28, 29 fit exactly into the lateral grooves 9, 10 of the mullion profiles 5 and seal these grooves 9, 10 off in the vertical direction to prevent possible infiltration water coming into grooves 9 and 10 and constitute as such a vertical barrier, so that the water cannot possibly pass through to an underlying module—the so-called waterfall principle or cascade drain, but possible infiltrated water is individually drained from each panel (or facade plane) separately.

The transom profiles 14 are preferably equipped to drain this water to the outside of the curtain wall 1, with the upper side of the transom profile 14 slanting downwards to the outside of the curtain wall 1, for example.

The raised leg 16 on the inside of the curtain wall prevents water from infiltrating to the inside.

Figure 9:
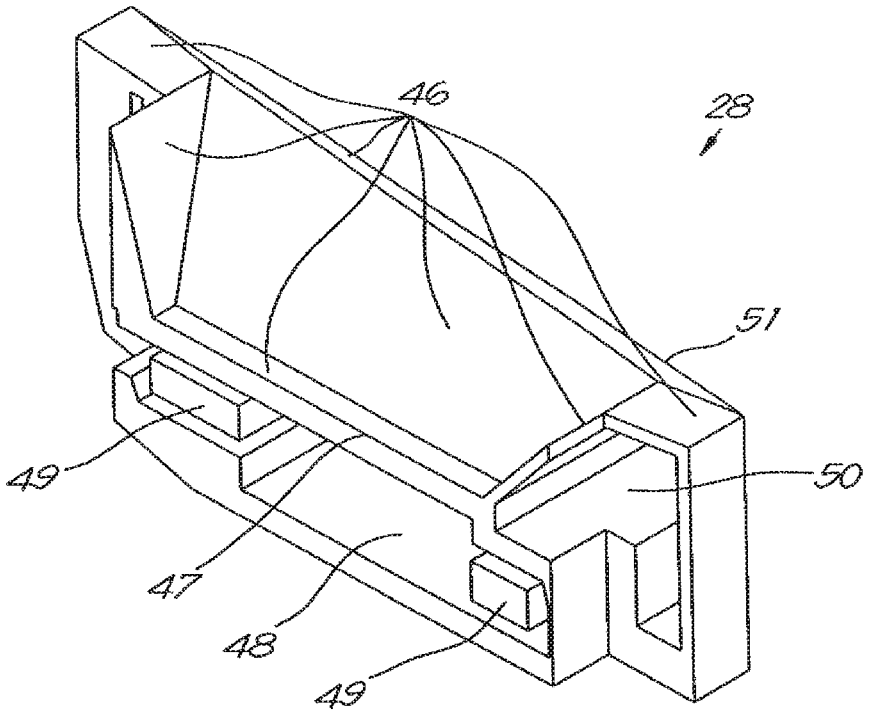
FIGS. 9 and 10 schematically show parts of the curtain wall of FIG. 1 in perspective.
Figure 10:
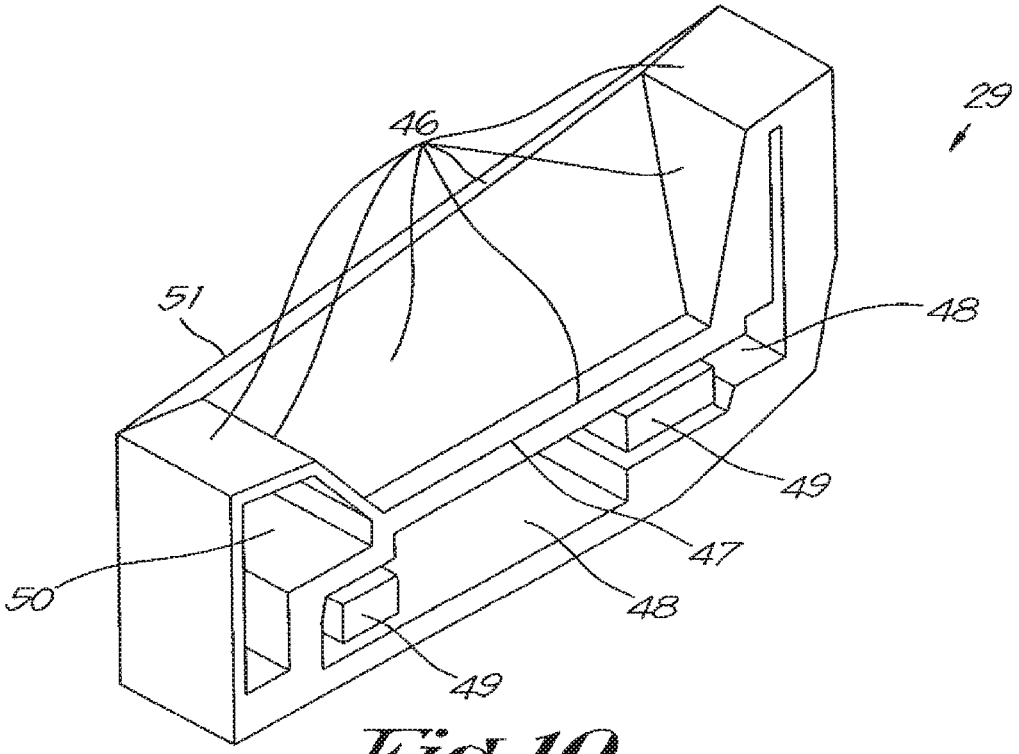

Details of these sealing pieces 28, 29 and the manner in which they are attached to the transom profiles 14 will be addressed later. These sealing pieces 28 and 29 are shown in FIGS. 3, 9 and 10 and are preferably manufactured in a single piece by injection moulding or the like.

In order to secure the attachment of the transom profiles 14 to the mullion profiles 5, the transom profiles 14 on the inside of the second leg 17 are provided with an undercut groove 30. At one or both ends of this undercut groove 30 is a rod, in this example an aluminium slat 32 mounted in the groove 30 so that it can be slid in the groove. When mounted, the slat 32 extends beyond the undercut groove 30 with a protruding end, said end is fitted in a second groove 13 of the mullion profiles 5 and acts as a lock.

Due to the fact that the groove 30 and the slat 32 are located on the inside of the outer vertical leg 17 of a transom profile 14, the transom profile 14, in its end position, can be locked from the inside during the construction of the curtain wall 1 by sliding slat 32 from a groove 30 into a groove 13 of a mullion profile 5.

The side edges 33 of the glass panels 4 are secured in the lateral grooves 9, 10 of the mullion profiles 5 by being fitted between the outer profile 7 of the mullion profiles 5 and the vertical glazing beads 34 on the inside of curtain wall 1. In this setup, rubber gaskets 35 are placed between the outer profile 7 and the glass panels 4, and between the vertical glazing beads 34 and the glass panels.

Glazing beads are profiles made out of a rigid material and which serve with the aid of a gasket to accommodate the play between the thickness of the panels 4 and the width A1 of the rabbet 11 or rather: to accommodate the differences in thickness between thicker or thinner panels. These glazing beads have a width that has to be adjusted to the thickness of the panels that are to be installed.

The vertical glazing beads 34 are attached to the mullion profiles 5 by means of first attachment aids 36, used in two variants, namely a first variant 36A for use in the deep lateral groove 9 and a second variant 36B for use in the shallow lateral groove 10.

These first attachment aids 36 are PVC profiles with a profile length of approximately 3 cm. At a distance of approximately 60 cm, they are snapped onto the mullion profiles 5 and the vertical glazing beads 34 are in turn snapped onto the first attachment aids 36.

The glazing beads 15 protrude to a certain height above the section 18 of the transom profiles 14 and together with the upwardly directed leg 16 of the transom profiles 14, they form a rabbet 37 for the lower edge 39 of an upper glass panel 4.

The lower edge 39 of the glass panels 4 is supported by glass supports 40 that are attached to the first leg 16 of the transom profiles 14, near the mullion profiles 5, as shown in FIG. 5.

The lower edge 39 of the glass panels 4 is fitted between the glazing beads 15 on the outside of the curtain wall 1 and a horizontal glazing bead 42 on the inside. There are rubber gaskets 35 inserted between the glazing beads 15 and the glass panels 4 and between the horizontal glazing beads 42 and the glass panels 4, as shown in FIG. 4.

The horizontal glazing beads 42 are attached to the transom profile 14 by means of second attachment aids 43 on the inside of the curtain wall 1 as shown in FIG. 4.

These second attachment aids 43 are PVC profiles with a profile length of approximately 3 cm. They are attached to the transom profiles 14 at intervals of about 60 cm and the horizontal glazing beads 42 are snapped onto the second attachment aids 43.

The upper edge 44 of the glass panels 4 is fitted between the glazing beads 15 on the outside of the curtain wall 1 and another horizontal glazing bead 45 on the inside which is provided with a rubber gasket 35 and which is snapped directly onto the transom profile 14.

It is noted that in some figures parts have been omitted to make other parts more visible. This is especially true of FIGS. 2 and 3, where in FIG. 2 mainly the sealing pieces 28, 29 and the ends of the transom profiles 14 are omitted, and in FIG. 3, mainly the glass panels 4, the vertical glazing beads 34 and the first attachment aids 36 for the vertical glazing beads 34 are omitted.

The manufacture and construction of the curtain wall 1 as described above is as follows.

First, the mullion profiles 5 and transom profiles 14 are prepared. At the positions where the transom profiles 14 are to be connected to the mullion profiles, the mullion profiles are provided with recesses 25, especially in the walls 26 defining the access opening 12 of the lateral grooves 9, 10. This is shown by means of shading in FIG. 6, which indicates where material of the mullion profiles 5 is removed, for example by milling. The obtained result is shown in FIG. 7.

The transom profiles 14 are also prepared. At their ends, a part of the transom profile 14 is milled for a length of about 11 mm. Shading indicates this part in FIG. 8.

These steps are normally, but not necessarily, automated and performed in a specialized workshop before the profiles 5,14 are transported to the location where the curtain wall 1 is to be built.

Next, the required glass supports 40 and second attachment aids 43 are provided in a groove routed for this purpose in the first leg 16.

Subsequently, sealing pieces 28, 29 are slid on the ends. These are shown in FIGS. 9 and 10 and exist in two variants, i.e. a first variant 28 as shown in FIG. 9, to be placed on the end of a transom profile 14 intended to be fitted into the shallow lateral groove 10 of the mullion profiles 5 and a second variant 29, as shown in FIG. 10, to be placed on the end of a transom profile 14 intended to be fitted in the deep lateral groove 9 of the mullion profiles 5.

The pre-assembled sealing pieces 28, 29 attached to the transoms both have an upper surface 46 formed from planes slanting to a lowest point 47 away from the bottom 9' or 10', respectively of the grooves 9 and 10 in which the sealing pieces 28, 29 are fitted. Also, both sealing pieces 28, 29 have a recess 48 for receiving the ends of the transom profiles 14 with two ridges 49 with corresponding positions and formats relative to the chambers 23 in the transom profiles 14.

These recesses 48 do not fully extend through the sealing pieces 28, 29. The walls 51 perpendicular to the transom profiles 14, i.e. the rear walls in FIGS. 9 and 10, are completely closed. The sealing pieces 28, 29 sealingly fit with these walls 51 against the bottom 9' and 10' of a groove 9 or 10 in which they have been mounted.

In top view, the sealing pieces 28, 29 are sized to fit precisely in the lateral grooves 9, 10.

Both sealing pieces 28, 29 are also provided with air chambers 50, wherein at the position of the air chambers 50, the outer wall is relatively thin so that the air chambers 50 are deformable.

The sealing pieces 28 according to the first variant are fixed permanently onto the transom profiles 14, for example by means of glue. The sealing pieces 29 of the second variant are slid onto the transom profiles 14 and are not secured further onto the transom profiles 14.

Then a previously mentioned aluminium slat 32 is fitted into the undercut groove 30 of the second leg 17 at both ends of the transom profiles 14.

Next, the mullion profiles 5 are mounted in their desired position.

Hereafter, the transom profiles 14, in an orientation in which they are rotated about 60° on their longitudinal axis and in which they are not horizontal, are held in the plane defined by the mullion profiles 14, as shown in FIG. 11.

The transom profiles 14 are now brought to a horizontal orientation, as indicated by arrow P, with the ends being inserted into the lateral grooves 9, 10 of the mullion profiles 5. Due to the direction of rotation of the transom profiles 14, rotated around their profile direction, these ends easily fit in the access openings 12 of these lateral grooves 9, 10.

Then the transom profiles 14 are moved downwardly until they are in their desired position, i.e. at the recesses 25 in the mullion profiles 5. Then the transom profiles 14 are rotated as indicated by arrow Q. The situation as shown in FIG. 12 is now reached.

Figure 12:
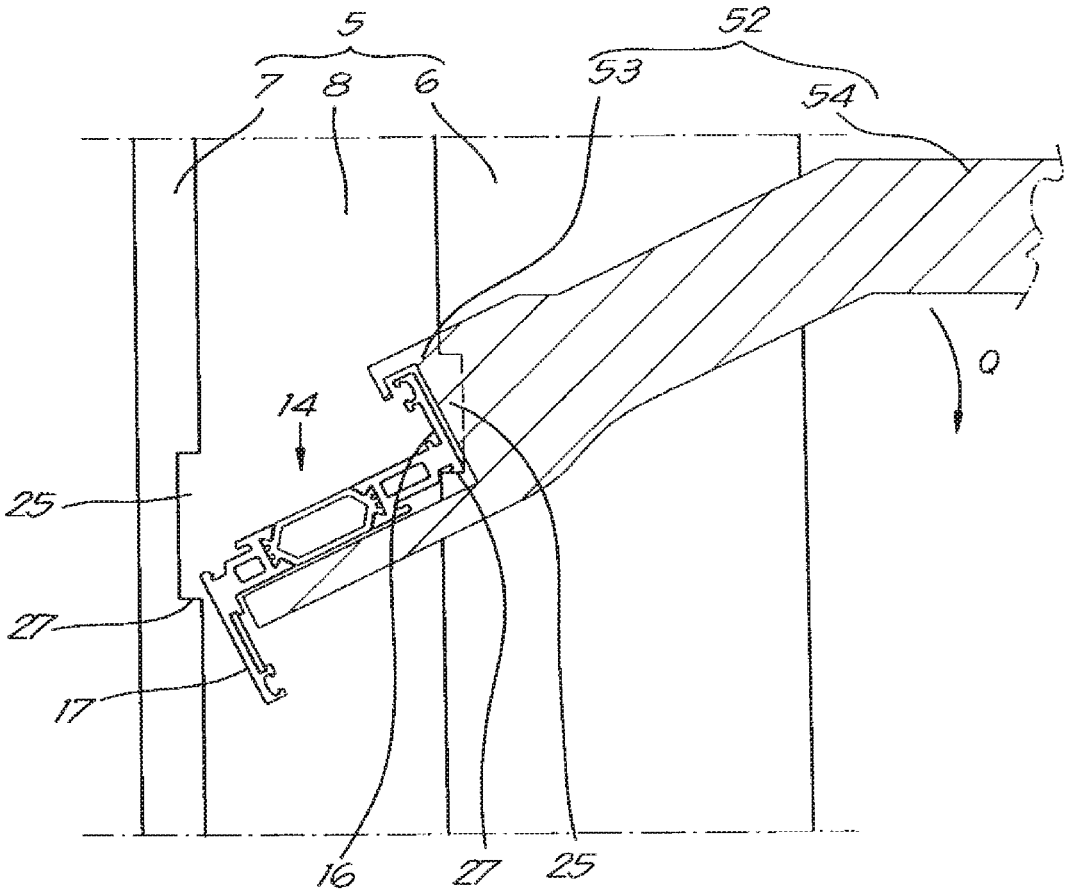
FIG. 12 schematically represents in cross-section analogous to FIG. 5 a next step in the manufacturing process of the curtain wall of FIG. 1.

The transom profiles 14 need to be rotated even further, starting from the situation as shown in FIG. 12. Because this requires relatively much force, preferably a tool 52 is used. This is a tool 52 with a head 53 with a partially complementary shape to the transom profile 14 and a lever 54 attached to the head 53. The lever 54 of the tool 52 is moved in the direction of arrow Q until the transom profile 14, as shown in FIGS. 4 and 5, is positioned in its end orientation in the recesses 25.

The sealing pieces 28, 29, more specifically their air chambers 50, deform considerably during this operation, but resume their original shape when the transom profile 14 is in its final orientation. The sealing pieces 28, 29 hereby completely close the lateral grooves 9, 10 in the vertical direction.

Next, the glazing beads 15 are attached with the gaskets 35 to the sub-profile 20 of the transom profiles 14 on the outside of the curtain wall. This can easily be done from the inside of the curtain wall using the clips 21.

Figure 13:
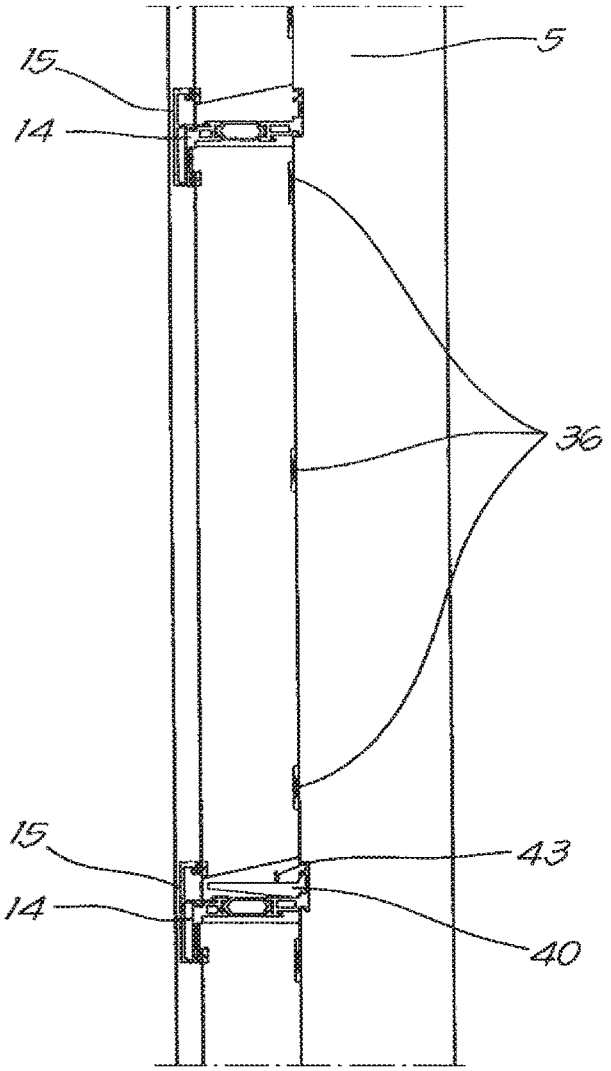
FIGS. 13 and 14 schematically represent in side view, and top view respectively, a next step in the manufacturing procedure of the curtain wall of FIG. 1, and FIGS. 15 and 16, schematically represent in side view, and top view respectively, a next step in the manufacturing procedure of the curtain wall of FIG. 1.
Figure 14:
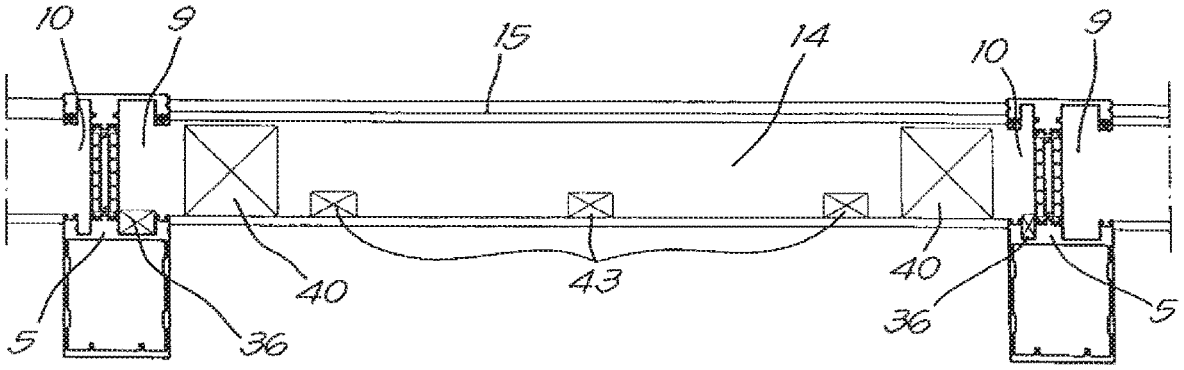

The glass supports 40 are pushed into their desired place, i.e. about 20 mm from the mullion profiles 5, and second attachment aids 43 are shifted until they are spread out over the length of the transom profiles 14, and the first attachment aids 36 for the vertical glazing beads 34 are snapped into their place as shown schematically in FIGS. 13 and 14.

The glass frame are already provided with rubber gaskets 35 and neoprene blocks 55 are glued onto the glass supports 46, as shown in FIG. 5.

The slats 32 in the undercut grooves are pushed outwardly until they slide with an end into the second groove 13. They are then fixed in that position, for example with a little glue or by a screw. The transom profiles 14 can now no longer separate from the mullion profiles 5.

The construction can now be provided with glass panels 4.

Figure 15:
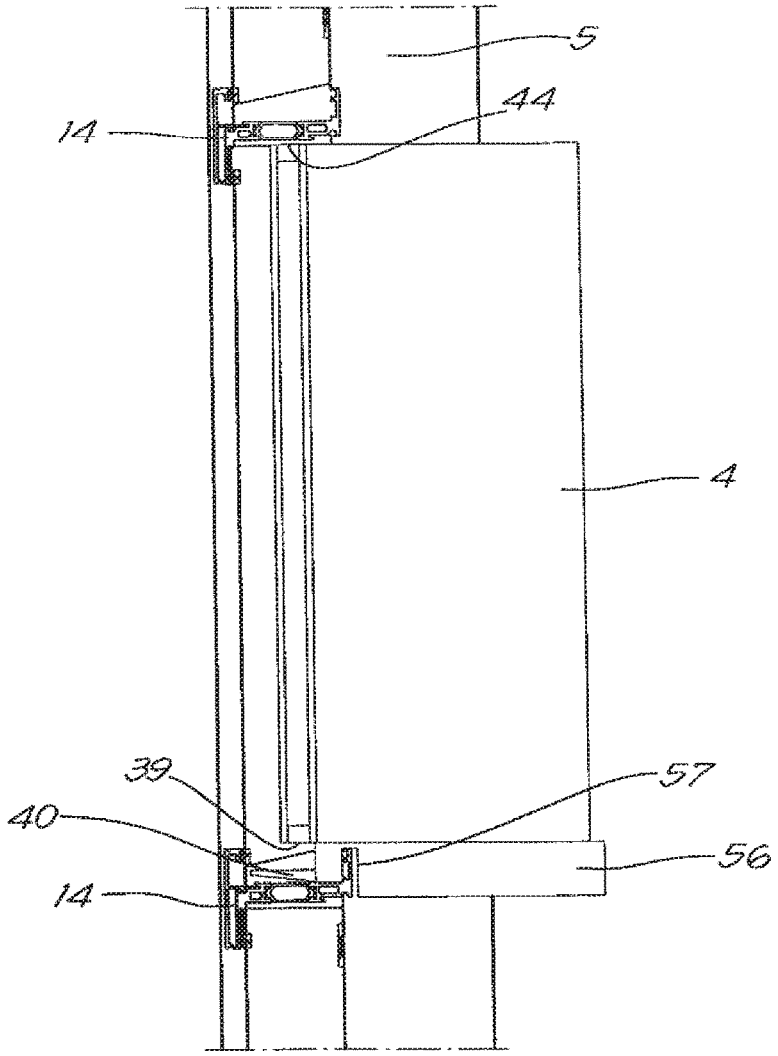
Figure 16:
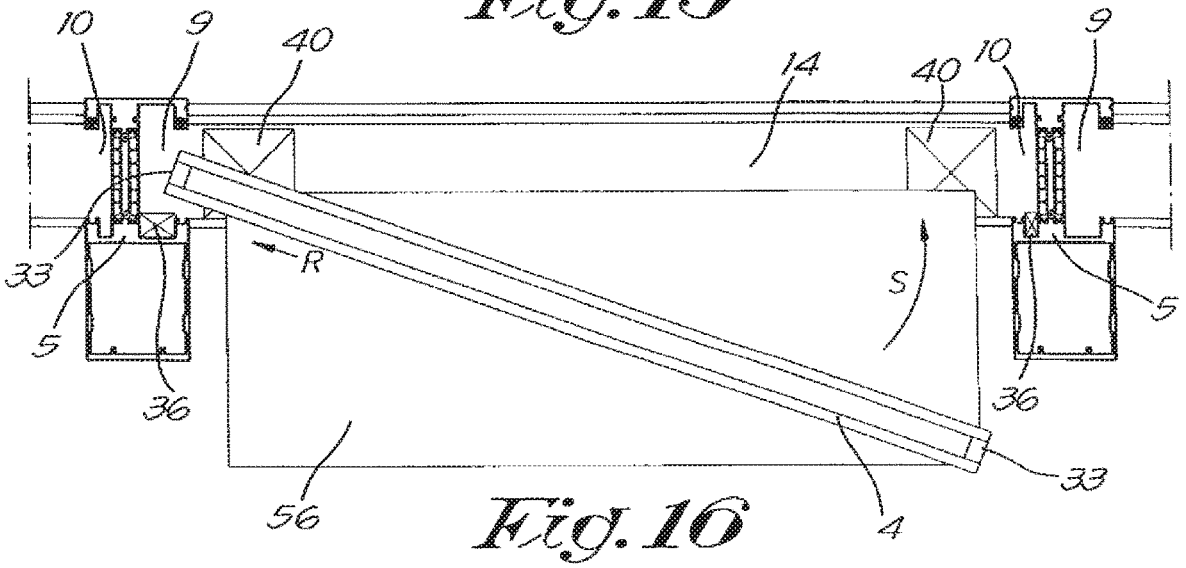

First, a wooden block 56 with a recess 57 for the first leg 16 is temporarily placed over the first leg 16. On top of this a glass panel 4 is placed in a slanted orientation. This is illustrated in FIGS. 15 and 16. The side edge 33 of the glass panel 4 that fits in the deep lateral groove 9 is now shuffled into this lateral groove 9 as indicated by arrow R.

Next, the other side edge 33 is shuffled along the opposite mullion section 5 as indicated by arrow S. To this end, the depth D1 of the groove 9 must be sufficient to shuffle the glass panel 4 sufficiently deep into this groove 9 with a pivotal movement of the glass panel 4 towards the shallow groove 10 and to then shuffle the glass panel 4 to the right, so that the glass panel 4 fits with both side edges 33 about 10 mm into a groove 9 or 10.

Then the glass panel 4 is centered so that it fits approximately 10 mm into both lateral grooves 9, 10 and then it is lowered onto the neoprene blocks 55. The wooden block 56 can now be removed.

Next, the horizontal and vertical glazing beads 34, 42, 45 and their gaskets 35 can be applied. The glazing beads 34, 42, 45 can simply be snapped into place along the inside of the curtain wall 1. At the upper horizontal glazing bead 45, this is done directly onto the transom profile 14. The lower horizontal glazing bead 42 is snapped onto the second attachment aids 43 and through this onto the transom profile 14. The vertical glazing beads 34 are snapped onto the first attachment aids 36 and through this onto the mullion profile 4.

Now the final curtain wall 1, as shown in FIGS. 1 to 5, is built.

It is noted that, outside of the parts where the glass supports 40 are attached and located just next to the mullion profiles 5, the transom profiles 14 have no bearing function for the glass panels 4.

If water reaches the horizontal gaskets 35 on the outside, this water is diverted to the outside through the drainage openings 24 into the glass frames 15 as shown in FIG. 5. If water gets to the vertical gaskets 35 into the lateral grooves 9, 10, it is diverted via the upper surfaces 46 of the sealing pieces 28 and 29 to the transom profiles 14 and from there it is drained to the outside via the drain openings 24 in the glass frames 15.

If wind or other causes engender slight deformations of the curtain wall 1, the transom profiles 14 can slide a few millimetres into the sealing pieces 29 according to the second variant, which causes less stress to the curtain wall 1. Movements and deformation can also be absorbed by rubber sealing pieces 28 and 29 without jeopardizing the waterproofness of the curtain wall 1.

Although the construction method described above is done from the inside, it is also possible from the outside, although an installation from the inside usually has advantages.

The present invention is by no means limited to the embodiment described as an example and shown in the drawings, but a curtain wall according to the invention can be realized in all kinds of variants, without departing from the scope of the invention, as defined by the claims.

The invention claimed is:

1. A curtain wall comprising:

one or more mullion profiles, one or more transom profiles and one or more panels, wherein the one or more mullion profiles consist of monolithic profiles, wherein the one or more mullion profiles do not comprise any perforations towards an outside of the curtain wall, wherein the one or more mullion profiles extend vertically, wherein the one or more transom profiles are attached at right angles to the one or more mullion profiles, wherein the one or more transom profiles and the one or more mullion profiles define rectangular openings, wherein the one or more panels are placed in said openings to close the openings, wherein side edges of the one or more panels are fitted in rabbets of the mullion profiles and of the transom profiles with seals, wherein the rabbets in the mullion profiles have a fixed indivisible width and wherein the one or more panels are secured along an inside of the curtain wall in the mullion profiles by means of first glazing beads that are composed of a rigid material and are provided with a respective said seal and are attached to the mullion profiles by means of first attachment aids, wherein the first attachment aids and the one or more mullion profiles are configured to snap the first attachment aids onto the mullion profiles, wherein the first attachment aids and the first glazing beads are configured to snap the first glazing beads onto the first attachment aids in a direction parallel to a plane of a respective panel of the one or more panels.

2. The curtain wall of claim 1, wherein the first attachment aids and the first glazing beads are designed to snap the first glazing beads together with the seals onto the first attachment aids in the direction parallel to the plane of the respective panel.

3. The curtain wall of claim 1, wherein the first glazing beads are made of aluminium.

4. The curtain wall of claim 1, wherein the first attachment aids are made of plastic.

5. The curtain wall of claim 1, wherein the first attachment aids and the one or more mullion profiles are designed to snap the first attachment aids to the mullion profiles in a direction perpendicular to the plane of the respective panel, wherein the first attachment aids and the first glazing beads are designed to snap the first glazing beads onto the first attachment aids in the direction parallel to the plane of the respective panel.

6. The curtain wall of claim 1, wherein the first attachment aids are profiles that extend over only a portion of a length of the first glazing beads.

7. The curtain wall of claim 1, wherein the first glazing beads are each secured to a respective mullion profile of the one or more mullion profiles by at least two first attachment aids that are spaced apart.

8. The curtain wall of claim 1, wherein the one or more panels are glass panels.

9. The curtain wall of claim 1, wherein the first glazing beads are fixed to mullion profiles only by means of first attachment aids.

10. The curtain wall of claim 1, wherein the transom profiles are Z-profiles with a first vertical leg directing upward and located on an inside of the transom profile and a second vertical leg directing downward and located on an outside of the transom profile and a horizontal section between the first and second leg.

11. The curtain wall of claim 1, wherein the seals are formed by flexible plastic or rubber.

12. The curtain wall of claim 1, wherein the one or more mullion profiles and the first glazing beads are arranged such that the first glazing beads rest against the mullion profiles, with a side of the first glazing beads facing away from the respective panel in question.

13. The curtain wall of claim 12, wherein the second glazing beads are fixed to transom profiles only by means of second attachment aids.

14. The curtain wall of claim 1, wherein the one or more panels are fixed by means of second glazing beads that are attached to the transom profiles by means of second attachment aids, wherein the second attachment aids and the one or more transom profiles are adapted to attach the second attachment aids to the transom profiles, wherein the second attachment aids and the second glazing beads are designed to snap the second glazing beads to the second attachment aids.

15. The curtain wall of claim 14, wherein the second attachment aids are profiles that extend over only a portion of a length of the second glazing beads and that the second glazing beads are each attached to a respective transom profile of the one or more transom profiles, by at least two second attachment aids that are spaced apart.

* * * * *